US010669751B2

(12) United States Patent
Kim et al.

(10) Patent No.: US 10,669,751 B2
(45) Date of Patent: Jun. 2, 2020

(54) APPARATUS FOR HOOD LATCH OF VEHICLE

(71) Applicants: Hyundai Motor Company, Seoul (KR); Kia Motors Corp., Seoul (KR); PYEONG HWA AUTOMOTIVE CO., LTD., Daegu (KR)

(72) Inventors: Sang Il Kim, Hwaseong-si (KR); Ki Ryun Ahn, Daegu (KR)

(73) Assignees: Hyundai Motor Company, Seoul (KR); Kia Motors Corp., Seoul (KR); PYEONG HWA AUTOMOTIVE CO., LTD., Daegu (KR)

( * ) Notice: Subject to any disclaimer, the term of this patent is extended or adjusted under 35 U.S.C. 154(b) by 606 days.

(21) Appl. No.: 15/363,827

(22) Filed: Nov. 29, 2016

(65) Prior Publication Data

US 2018/0073283 A1 Mar. 15, 2018

(30) Foreign Application Priority Data

Sep. 13, 2016 (KR) ..... 10-2016-0118122

(51) Int. Cl.

| | |
|---|---|
| ***E05B 81/20*** | (2014.01) |
| ***E05B 81/72*** | (2014.01) |
| ***E05B 81/66*** | (2014.01) |
| ***E05B 81/06*** | (2014.01) |
| ***E05B 83/24*** | (2014.01) |

(52) U.S. Cl.

CPC ..... *E05B 81/20* (2013.01); *E05B 81/06* (2013.01); *E05B 81/66* (2013.01); *E05B 81/72* (2013.01); *E05B 83/24* (2013.01)

(58) Field of Classification Search

CPC ..... E05B 81/06; E05B 81/20; E05B 81/66; E05B 81/72; E05B 81/68; E05B 83/24; Y10S 292/14; Y10S 292/42; Y10S 292/43; Y10T 292/1047; Y10T 292/1082

See application file for complete search history.

(56) References Cited

U.S. PATENT DOCUMENTS

| | | | | | |
|---|---|---|---|---|---|
| 4,763,936 | A * | 8/1988 | Rogakos | E05B 81/20 | 292/201 |
| 5,411,302 | A * | 5/1995 | Shimada | E05B 81/20 | 292/201 |
| 5,423,582 | A * | 6/1995 | Kleefeldt | E05B 81/20 | 292/201 |
| 5,765,884 | A * | 6/1998 | Armbruster | E05B 81/20 | 292/1 |
| 5,868,444 | A * | 2/1999 | Brackmann | E05B 81/20 | 292/196 |

(Continued)

FOREIGN PATENT DOCUMENTS

| | | | | |
|---|---|---|---|---|
| DE | 10309643 | A1 * | 9/2004 | E05B 81/20 |
| DE | 102017108265 | A1 * | 10/2018 | E05B 81/20 |

(Continued)

*Primary Examiner* — Alyson M Merlino
(74) *Attorney, Agent, or Firm* — Morgan, Lewis & Bockius LLP

(57) ABSTRACT

An apparatus for a hood latch of a vehicle may include a hood, wherein the hood is completely closed by an operation of a cinching mechanism when the incomplete closing of the hood is detected to perform the closing of the hood, preventing a safety accident.

16 Claims, 9 Drawing Sheets

(56) References Cited

U.S. PATENT DOCUMENTS

| | | | | | |
|---|---|---|---|---|---|
| 5,938,252 | A * | 8/1999 | Uemura | E05B 81/20 | 292/201 |
| 6,048,003 | A * | 4/2000 | Shimura | E05B 81/20 | 292/201 |
| 6,053,542 | A * | 4/2000 | Ostrowski | E05B 81/20 | 292/201 |
| 6,145,354 | A * | 11/2000 | Kondo | E05B 81/20 | 292/201 |
| 2010/0194120 | A1 * | 8/2010 | Kaiser | E05B 81/20 | 292/198 |

FOREIGN PATENT DOCUMENTS

| | | | | | |
|---|---|---|---|---|---|
| JP | H07-269209 | A | 10/1995 | | |
| JP | 2805569 | B2 | 7/1998 | | |
| JP | 2011-017172 | A | 1/2011 | | |
| KR | 10-0520966 | | 10/2005 | | |
| KR | 10-2006-0018355 | A | 3/2006 | | |
| KR | 10-0728445 | B1 | 6/2007 | | |
| KR | 10-0877860 | B1 | 1/2009 | | |
| KR | 10-2010-0019468 | | 2/2010 | | |
| WO | WO-2013087454 | A1 * | 6/2013 | | E05B 83/24 |

* cited by examiner

APPARATUS FOR HOOD LATCH OF VEHICLE

CROSS REFERENCE TO RELATED APPLICATION

The present application claims priority to Korean Patent Application No. 10-2016-0118122, filed on Sep. 13, 2016, the entire contents of which is incorporated herein for all purposes by this reference.

BACKGROUND OF THE INVENTION

Field of the Invention

The present invention relates to an apparatus for a hood latch of a vehicle, and more particularly, to an apparatus for a hood latch of a vehicle configured for preventing a hood from opening by completely closing the hood.

Description of Related Art

Generally, a front of a vehicle is provided with an engine compartment that is shielded by a hood to protect internal components of the vehicle.

The hood is configured to open or close the engine compartment and lock or unlock a latch to a striker mounted in a vehicle body. In particular, when the hood is incompletely closed, the hood is suddenly open and thus a safety accident may occur and when the hood is open while driving, a driver's view may be blocked.

Further, only which a typical hood needs to completely be taken down with a strong force, the hood is completely closed in the state in which the engine room is closed. In particular, a female driver does not cope with a weight of the hood and therefore has a difficulty in closing the hood with a sufficient force, such that the situation that the hood is incompletely closed may frequently occur.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing apparatus to completely close a hood that is in an incompletely closed state. Various aspects of the present invention are directed to providing an apparatus for a hood latch of a vehicle configured for stably maintaining a closed state of a hood after the hood is configured to be closed by completely closing the hood that is in an incompletely closed state.

According to an exemplary embodiment of the present invention, there is provided an apparatus for a hood latch of a vehicle, including: a base configured to be provided with a driving motor and an insertion groove into which a striker is inserted; a latch lever configured to be adjacently positioned to the insertion groove of the base, rotatably mounted by the striker inserted into the insertion groove, and formed to enclose the striker; a pawl lever configured to be rotatably mounted by interlocking with the latch lever and locked to the latch lever when the latch lever is rotated to enclose the striker to thereby fix the latch lever to prevent the latch lever from rotating; a cinching mechanism configured to be adjacently positioned to the insertion groove while being spaced apart from the latch lever and rotatably mounted together with the latch lever when the striker is inserted into the insertion groove and is additionally rotated by being supplied with power of the driving motor; and a switch part configured to be turned on/off depending on a rotation state of the latch lever and drive the driving motor when the switch part is configured to be turned on by the rotation of the latch lever.

The latch lever may be provided with a latch groove depressed to have the striker inserted thereinto, an extending part extended to correspond to the insertion groove to contact the striker, and a locking protrusion radially protruding along a circumference and may be mounted to elastically return after the rotation of the latch lever.

The pawl lever may be provided with a projection locked to the locking protrusion in a state in which the latch lever is rotated and may be mounted to elastically return so that the latch lever returns to an original position after the rotation.

The pawl lever may be provided with a contact end that is extended to be bent and thus the locking protrusion may contact a contact end when the latch lever is rotated, and a tip of the contact end may be provided with a projection.

The cinching mechanism may include: a popup lever configured to be adjacently positioned to the insertion groove while being spaced apart from the latch lever and rotatably installed together with the latch lever when the striker is inserted into the insertion groove; and a cinching lever configured to be rotatably mounted to be adjacent to the popup lever, rotated by being supplied with the power of the driving motor, and rotated together with the popup lever when the cinching lever is rotated.

The popup lever may be provided with a contact part that is extended to correspond to the insertion groove to contact the striker.

The contact part of the popup lever may be protrudedly provided with a pin protrusion and the pin protrusion may be connected to the elastic member mounted at the base to apply an elastic force so that the popup lever is rotated in a direction in which the striker is separated from the insertion groove.

The cinching lever may be applied with a pulling force from the driving motor to be rotated and may be connected to a restoring member mounted at the base in an opposite direction to a direction in which the pulling force is applied.

The cinching lever may be protrudedly provided with a guide protrusion and the popup lever may be provided with a corresponding protrusion contacting the guide protrusion when the cinching lever is rotated by the operation of the driving motor.

The apparatus may further include: a switching lever rotatably mounted while interlocking with the latch lever when the latch lever is rotated, in which the switch part may be configured to include a first switch part turned on/off depending on a rotation of the switching lever and a second switch part turned on/off depending on a rotation of the pawl lever rotated by the latch lever.

The latch lever may be protrudedly provided with a fixed protrusion and the switching lever may be mounted to be elastically rotated in the direction in which the striker is inserted into the insertion groove and be provided with the locking part extended toward the latch lever to be locked to the fixed protrusion.

The base may be provided with a guide groove extended along a rotation radius of the switching lever and the switching lever may be provided with a guide protrusion moving by being guided along the guide groove while being inserted into the guide groove.

The first switch part may be configured to input a turn on by contacting the switching lever when the switching lever is rotated as the latch lever is rotated by inserting the striker into the insertion groove and the second switch part may be configured to be turned on by making the contact within the rotation section from a point where the pawl lever is rotated to a point before the pawl lever is locked to the latch lever as the striker is inserted into the insertion groove.

When both of the first switch part and the second switch part are turned on, the driving motor may be operated and when either the first switch part or the second switch part is not turned on, the driving motor may not be operated.

When the striker is not inserted into the insertion groove, as the latch lever is not rotated, the switching lever and the pawl lever may be also not rotated, such that the first switch part and the second switch part may be turned off and thus the driving motor may not be operated.

When the striker is inserted into the insertion groove, the switching lever and the pawl lever may be rotated together as the latch lever is rotated, and thus the first switch part may be turned on by the switching lever and the second switch part may be turned on by the pawl lever to operate the driving motor to additionally rotate the cinching mechanism to allow the latch lever to be fixed while enclosing the striker.

The apparatus may further include: a hook lever configured to be rotatably mounted at the base, have a hook-shaped hook part extended to correspond to the insertion groove, rotated when the striker moves toward the insertion groove to allow a movement of the striker, and be locked to the hook part when the striker moves in a direction in which it is separated from the insertion groove to limit a movement of the striker.

The apparatus may further include: a release lever configured to be rotatably mounted at the base and connected to be rotated together with the pawl lever and the hook lever when the release lever is rotated.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
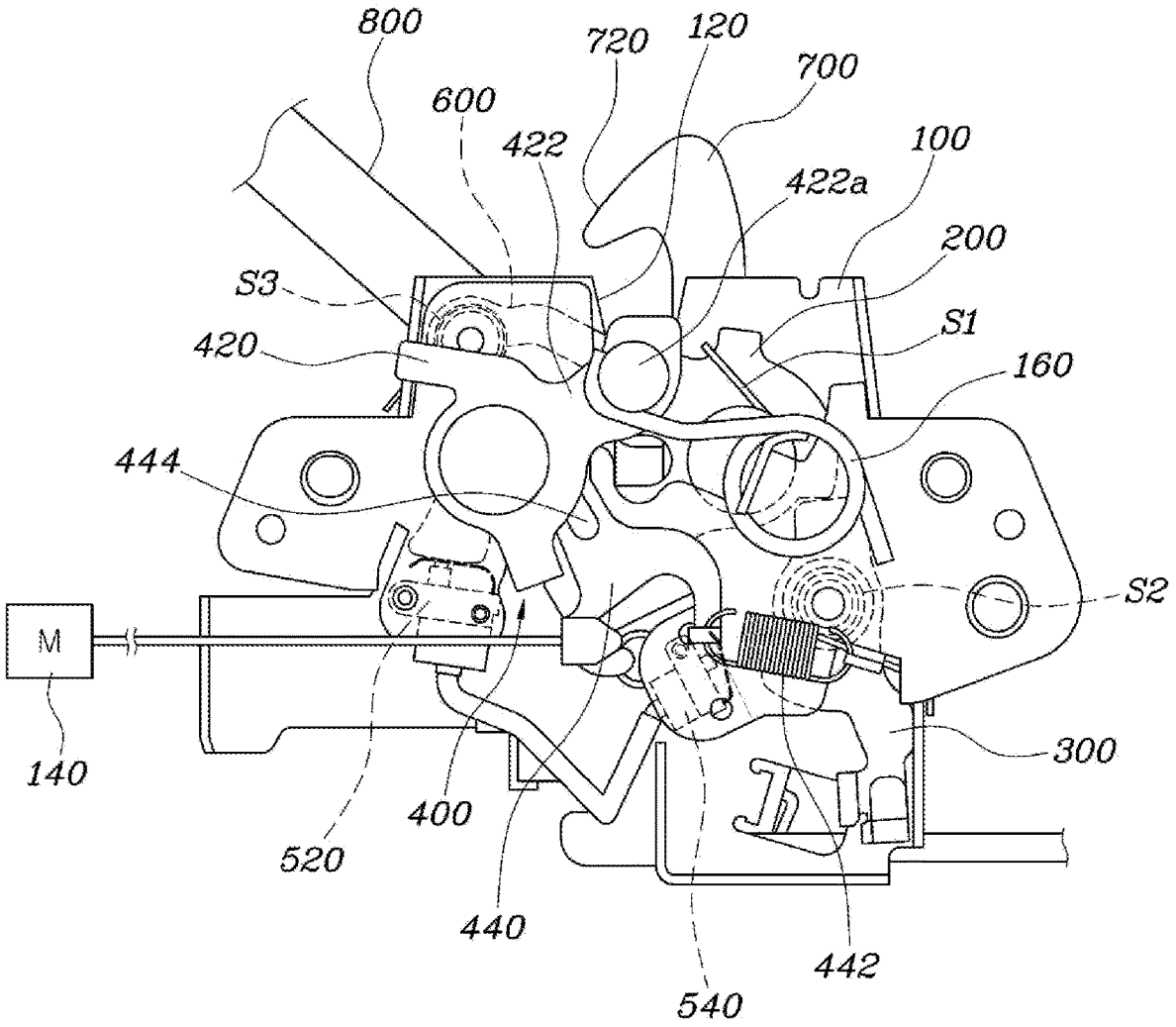
FIG. 1 is a diagram illustrating an apparatus for a hood latch of a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, an apparatus for a hood latch of a vehicle according to an exemplary embodiment of the present invention will be described with reference to the accompanying drawings.

Figure 2:
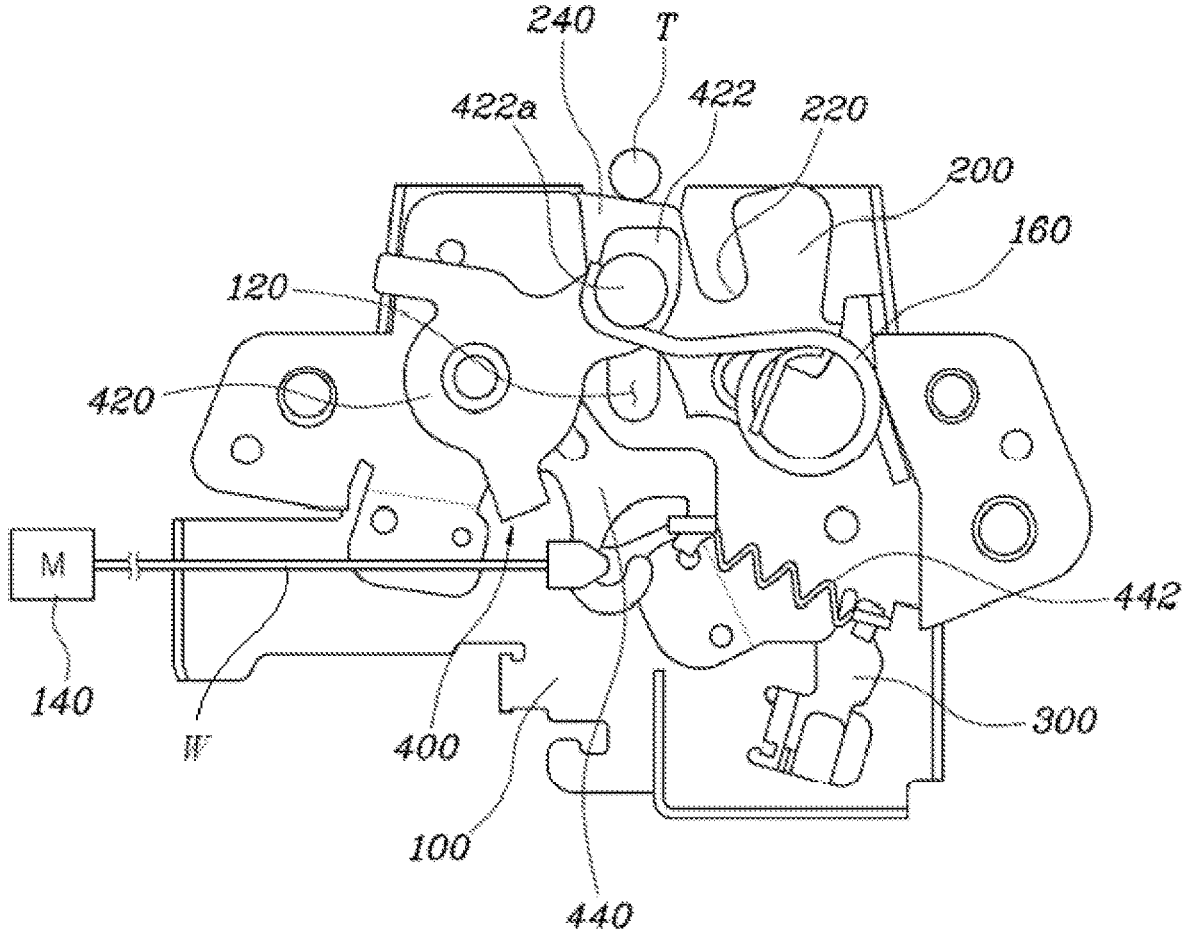
FIG. 2, FIG. 3 and FIG. 4 are diagrams illustrating an operation process of the apparatus for a hood latch of a vehicle illustrated in FIG. 1.
Figure 3:
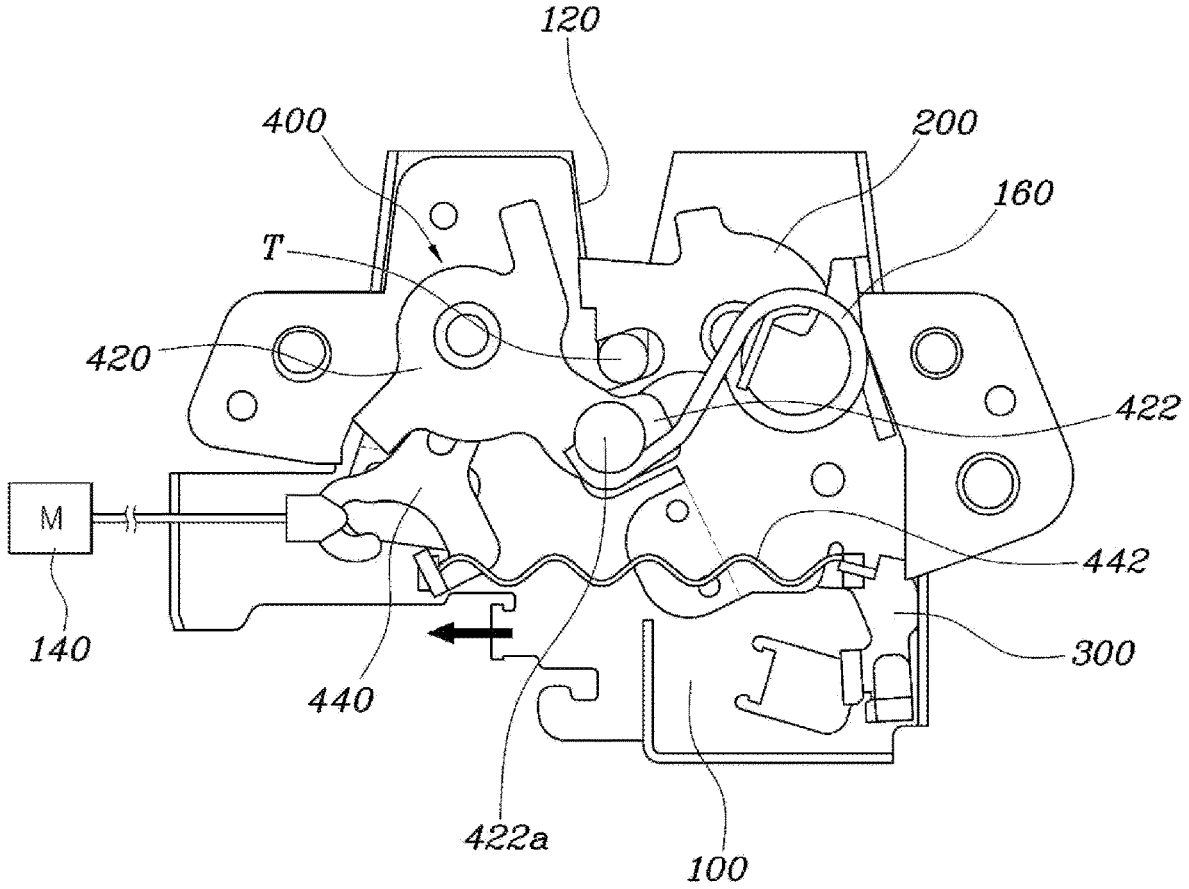
Figure 4:
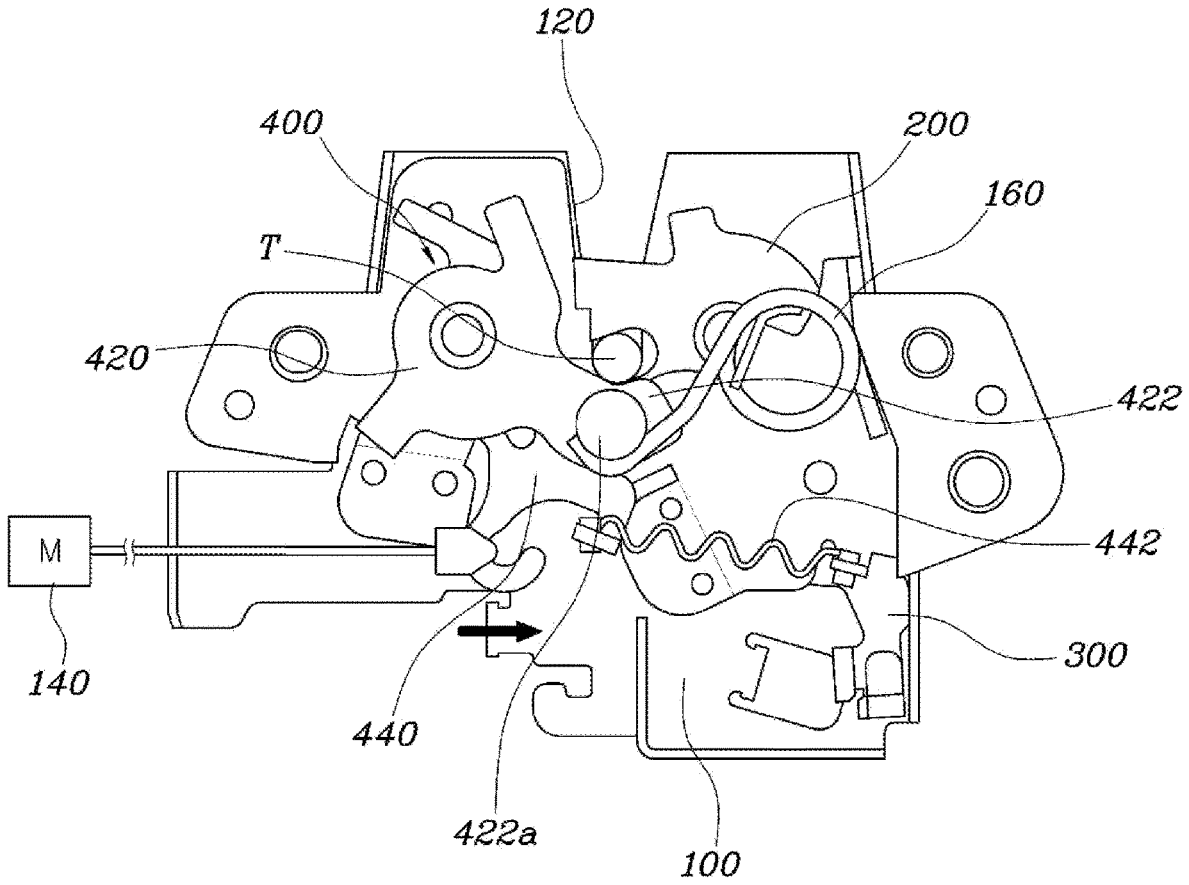

FIG. 1 is a diagram illustrating an apparatus for a hood latch of a vehicle according to an exemplary embodiment of the present invention, FIGS. 2 to 4 are diagrams illustrating an operation process of the apparatus for a hood latch of a vehicle illustrated in FIG. 1, and FIGS. 5 to 9 are diagrams for describing the apparatus for a hood latch of a vehicle illustrated in FIG. 1.

FIGS. 2 to 4 are to describe the operation process of the apparatus for a hood latch of a vehicle according to the exemplary embodiment of the present invention, and illustrate only components required for description.

Further, FIGS. 5 and 6 and FIGS. 7 to 9 illustrate required components to easily understand the configuration of the present invention with respect to FIG. 1 and do not illustrate components unnecessary for description to more easily understand the present invention.

As illustrated in FIG. 1, the apparatus for a hood latch of a vehicle according to the exemplary embodiment of the present invention includes: a base 100 configured to be provided with a driving motor 140 and an insertion groove 120 into which a striker T is inserted; a latch lever 200 configured to be adjacently positioned to the insertion groove 120 of the base 100, rotatably mounted by the striker T inserted into the insertion groove 120, and enclose the striker T; a pawl lever 300 configured to be rotatably mounted by interlocking with the latch lever 200 and locked to the latch lever 200 when the latch lever 200 is rotated to enclose the striker T to fix the latch lever 200 to prevent the latch lever 200 from rotating; a cinching mechanism 400 configured to be adjacently positioned to the insertion groove 120 while being spaced apart from the latch lever 200 and rotatably mounted together with the latch lever 200 when the striker T is inserted into the insertion groove 120 and is additionally rotated by being supplied with power of the driving motor 140; and a switch part 500 configured to be turned on/off depending on a rotation state of the latch lever 200 and drive the driving motor 140 when the switch part 500 is configured to be turned on by the rotation of the latch lever 200.

Further, the apparatus for a hood latch of a vehicle may further include a hook lever 700 configured to be rotatably mounted at the base 100, have a hook-shaped hook part 720 extended to correspond to the insertion groove 120, be rotated when the striker T moves toward the insertion groove 120 to allow a movement of the striker T, and be locked to the hook part 720 when the striker T moves in a direction in which it is separated from the insertion groove 120 to limit a movement of the striker T.

By doing so, the latch lever 200, the pawl lever 300, the cinching mechanism 400, the switch part 500, and the hook lever that are mounted at the base 100 are smoothly operated while the interference between the respective parts is configured to be reduced. Further, to reduce a package, the parts connected with the cinching mechanism 400 with respect to the base 100 are preferably mounted on a front surface of the base and the pawl lever 300, the switching lever 600, and the hook lever 700 are preferably mounted on a back surface thereof.

The apparatus for a hood latch of a vehicle according to the exemplary embodiment of the present invention is configured to include the latch lever 200, the pawl lever 300, the cinching mechanism 400, the switch part 500, and the hook lever 700 that are mounted at the base 100, in which the base 100 is mounted at the hood and the striker T is mounted at the vehicle body to allow the latch lever 200 to enclose the striker T when the striker T is inserted into the insertion groove 120 of the base 100, such that a locking operation of fixing the hood to the vehicle body is performed.

According to the exemplary embodiment of the present invention, as illustrated in FIGS. 1 to 4, when the hood is closed, the striker T moves toward the insertion groove 120 of the striker T while pushing the hook lever 700 to rotate the hook lever 700. At this point, as the striker T is locked to the hook part 720 of the hook lever 700 and thus the separation of the striker T is limited, a one-stage locking is performed and the striker T contacts the latch lever 200 and the cinching mechanism 400. The one-stage locking is an incomplete locking state.

Here, when the latch lever 200 and the cinching mechanism 400 are rotated by the striker T due to a self weight of the hood, the switch part 500 senses the rotation of the latch lever 200 to be turned on and the driving motor 140 receiving the signal is operated, such that the cinching mechanism 400 is supplied with power of the driving motor 140 to be forcibly rotated additionally. At this point, as the cinching mechanism 400 is rotated, the latch lever 200 is naturally rotated by the self weight of the hood to enclose the striker T and when the rotation of the latch lever 200 is completed, the pawl lever 300 is locked to the latch lever 200 to limit the rotation of the latch lever 200, such that the state in which the latch lever 200 encloses the striker T is fixed. As a result, a two-stage locking is completed, and thus the hood is completely fixed to the vehicle body.

Further, when the two-stage locking is performed and thus the latch lever 200 is rotated up to a position where it is locked to the pawl lever 300, the switch part 500 is configured to be turned off, such that a position of the latch lever 200 is fixed by the pawl lever 300 and the cinching mechanism 400 returns to an original position as the driving motor 140 is not operated. As a result, the completed closed state of the hood may be maintained.

Figure 5:
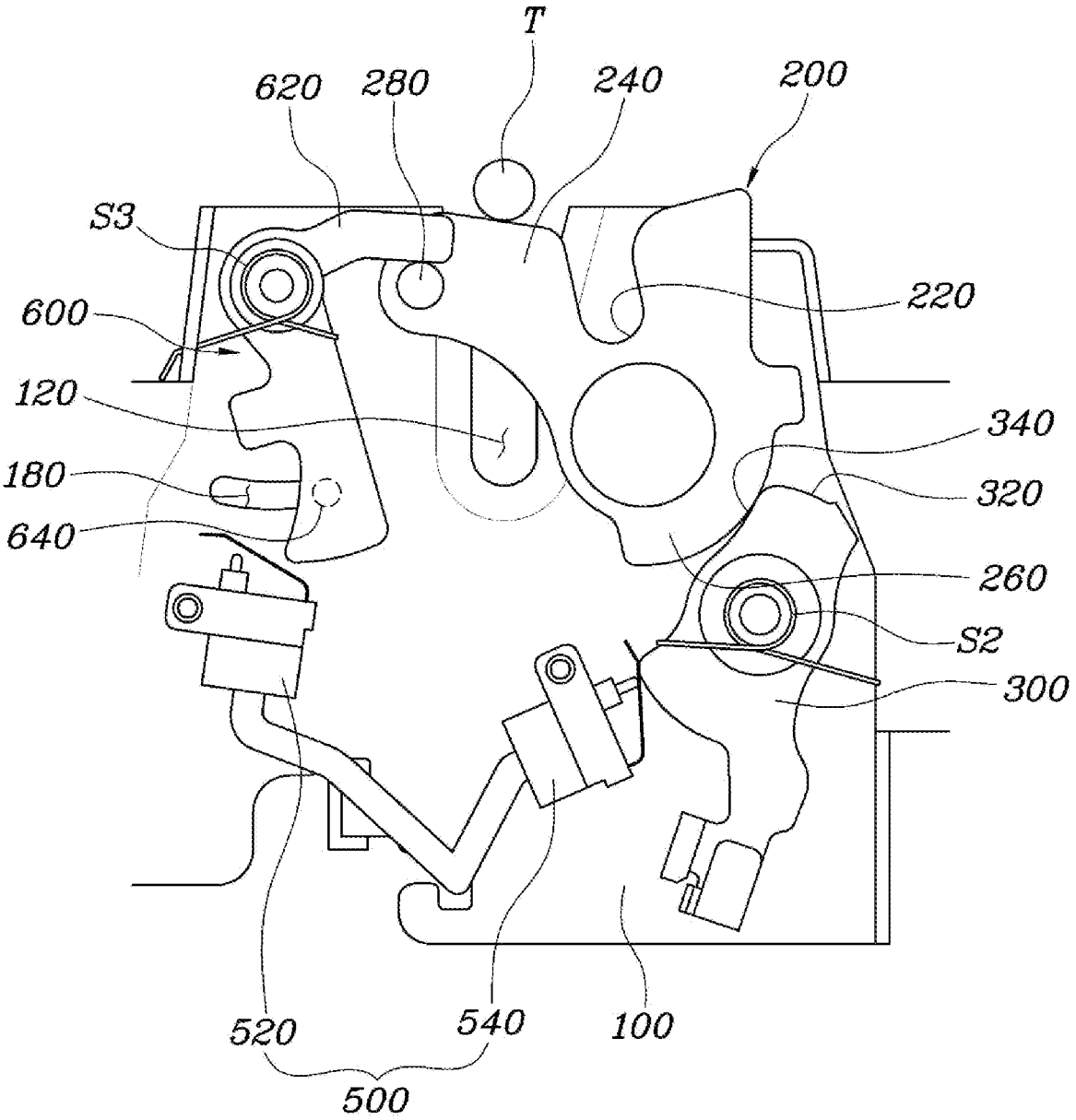
FIG. 5, FIG. 6, FIG. 7, FIG. 8, and FIG. 9 are diagrams for describing the apparatus for a hood latch of a vehicle illustrated in FIG. 1.

Describing in detail the present invention, as illustrated in FIGS. 1 and 5, the latch lever 200 is provided with a latch groove 220 depressed to have the striker T inserted thereinto, an extending part 240 extended to correspond to the insertion groove 120 to contact the striker T, and a locking protrusion 260 radially protruding along a circumference and may be mounted to elastically return after the rotation of the latch lever 200. Here, as illustrated in FIG. 1, the latch lever 200 may be configured to be elastically rotated by a torsion spring S1.

By doing so, the latch lever 200 is provided with the extending part 240 extended to correspond to the insertion groove 120 and is thus rotated as the extending part 240 is pushed when the striker T is inserted into the insertion groove 120 and the latch groove 220 is formed following the extending part 240 and thus the striker T may naturally move from the extending part 240 to the insertion groove 120 to be inserted into the insertion groove 120 when the latch lever 200 is rotated. Further, the latch lever 200 is provided with the locking protrusion 260 radially protruding along the circumference and the locking protrusion 260 is locked to the pawl lever 300 to be described below to limit the rotation of the latch lever 200, such that the rotated position of the latch lever 200 may be fixed.

Figure 8:
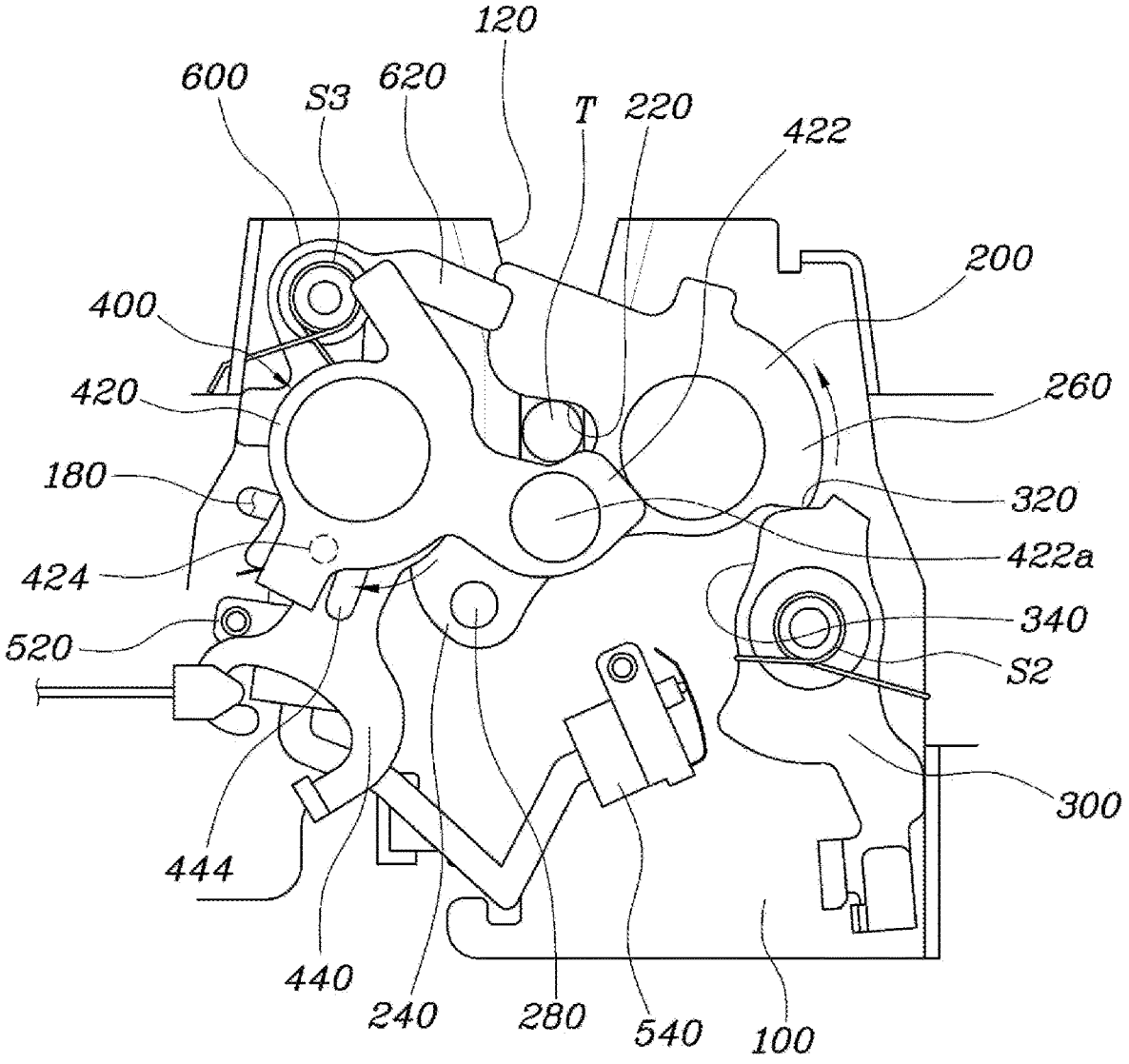

Meanwhile, the pawl lever 300 may be provided with a projection 320 locked to the locking protrusion 260 in the state in which the latch lever 200 is rotated and may be mounted to elastically return so that the latch lever returns to an original position after the rotation. Referring to FIG. 8, when the pawl lever 300 is provided with the projection 320 and when the rotation of the latch lever 200 is completed, the locking protrusion 260 of the latch lever 200 is locked to the projection 320 of the pawl lever 300, and thus the rotated position of the latch lever 200 may be fixed. Here, the pawl lever 300 may be connected to a torsion spring S2 mounted at the base 100 so that the rotated position returns to an original position.

Further, the pawl lever 300 is provided with a contact end 340 that is extended to be bent and thus the locking protrusion 260 contacts the contact end 340 when the latch lever 200 is rotated, and a tip of the contact end 340 may be provided with the projection 320. By doing so, as the pawl lever 300 is provided with the contact end 340, the locking protrusion 260 smoothly pushes the contact end 340 that is extended to be bent to rotate the pawl lever 300 when the latch lever 200 is rotated and as the tip of the contact end 340 is provided with the projection 320, the locking protrusion 260 of the latch lever 200 moves along the contact end 340 and then may be smoothly locked to the projection 320.

Figure 7:
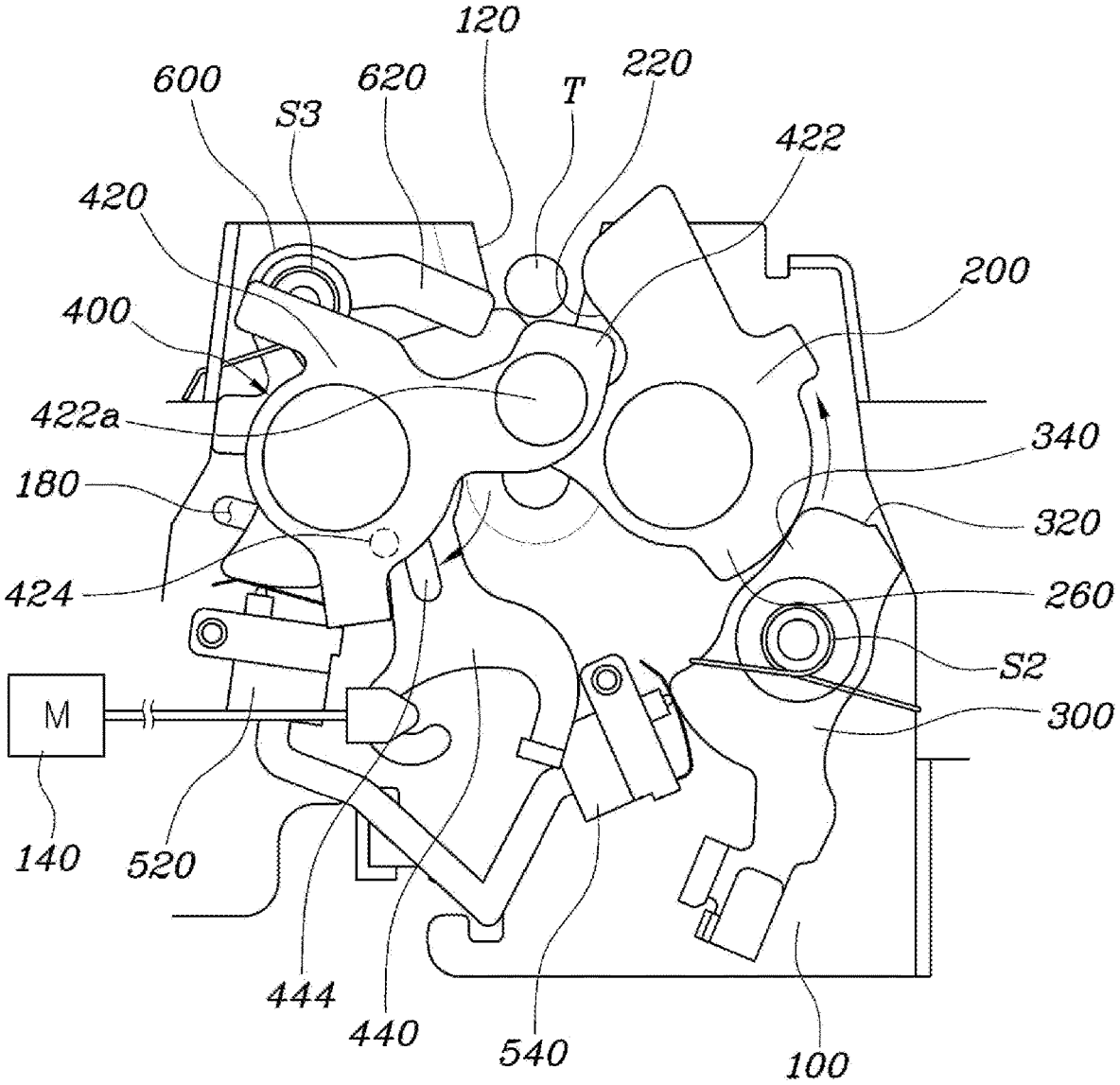

Meanwhile, as illustrated in FIGS. 1 and 7, the cinching mechanism 400 may include a popup lever 420 configured to be adjacently positioned to the insertion groove 120 while being spaced apart from the latch lever 200 and rotatably mounted together with the latch lever 200 when the striker T is inserted into the insertion groove 120; and a cinching lever 440 configured to be rotatably mounted to be adjacent to the popup lever 420, rotated by being supplied with the power of the driving motor 140, and rotated together with the popup lever 420 when the cinching lever 440 is rotated. That is, the cinching mechanism 400 is configured to include the popup lever 420 and the cinching lever 440 and the popup lever 420 pushes the striker T with an elastic force of an elastic member 160 to be described below while being rotated by the striker T inserted into the insertion groove 120 so that the striker T may be separated from the insertion groove 120. The cinching lever 440 is configured to be rotated while interlocking with the popup lever 420 and as the striker T is inserted into the insertion groove 120, the popup lever 420 is independently rotated because the popup lever 420 does not interfere with the cinching lever 440 when the popup lever 420 is rotated and as the driving motor 140 is operated, the popup lever 420 is pulled when the cinching lever 440 is rotated and is rotated together with the cinching lever 440.

In detail, as illustrated in FIG. 7, the popup lever 420 may be provided with a contact part 422 that is extended to correspond to the insertion groove 120 to contact the striker T. The contact part 422 of the popup lever 420 is formed to be extended up to a same position as a position of the extending part 240 provided with the latch lever 200, such that the popup lever 420 may be rotated together with the latch lever 200 by the striker T inserted into the insertion groove 120.

Here, as illustrated in FIG. 1 and FIG. 2, the contact part 422 of the popup lever 420 is protrudedly provided with a pin protrusion 422*a* and the pin protrusion 422*a* may be connected to the elastic member 160 mounted at the base 100 to apply an elastic force so that the popup lever 420 is rotated in the direction in which the striker T is separated from the insertion groove 120. By doing so, as the popup lever 420 is supplied with the elastic force by the elastic member 160 connected to the pin protrusion 422*a*, the popup lever 420 is configured to be rotated in the direction in which the striker T is separated from the insertion groove 120. Therefore, when the striker T is separated from the insertion groove 120 as the pawl lever 300 rotates the latch lever 200 when the hood is open, the popup lever 420 is rotated by the elastic force of the elastic member 160 connected to the pin protrusion 422*a* to push the striker T, thereby naturally opening the hood. Further, the popup lever 420 elastically supports the striker T with the elastic force of the elastic member 160 when the striker T is inserted into the insertion groove 120, thereby reducing the shock occurrence due to the insertion of the striker T into the insertion groove 120.

Meanwhile, as illustrated in FIG. 2, the cinching lever 440 is applied with a pulling force from the driving motor 140 to be rotated and may be connected to a restoring member 442 mounted at the base 100 in an opposite direction to a direction in which the pulling force is applied. Here, the cinching lever 440 may be connected to the driving motor 140 by a wire W and the wire is pulled at a time of the operation of the driving motor 140 and the cinching lever 440 is rotated in the direction in which the pulling force of the wire is applied. Further, the cinching lever 440 is connected to the restoring member 442 in the opposite direction to apply the elastic force in the opposite direction to the direction in which the pulling force by the driving motor 140 is applied, such that the cinching lever 440 may return to an original position by the elastic force of the restoring member 442 when the driving motor 140 stops.

Meanwhile, the cinching lever 440 is protrudedly provided with a guide protrusion 444 and the popup lever 420 may be provided with a corresponding protrusion 424 contacting the guide protrusion 444 when the cinching lever 440 is rotated by the operation of the driving motor 140. However, the popup lever 420 does not interfere with the cinching lever 440 when being rotated and the popup lever 420 needs to be rotated together with the cinching lever 440 when the cinching lever 440 is rotated. As illustrated in FIG. 7, the corresponding protrusion 424 of the popup lever 420 needs to be mounted in the rotating direction in which it is pulled and rotated by the striker T rather than by the guide protrusion 444 for the cinching lever 440.

Meanwhile, as illustrated in FIGS. 1 and 5, the apparatus for a hood latch of a vehicle may further include a switching lever 600 configured to be rotatably mounted while interlocking with the latch lever 200 when the latch lever 200 is rotated, in which the switch part 500 may be configured to include a first switch part 520 turned on/off depending on a rotation of the switching lever 600 and a second switch part 540 turned on/off depending on a rotation of the pawl lever 300 rotated by the latch lever 200. The first switch part 520 and the second switch part 540 are configured to be turned on/off by detecting contacts from the switching lever 600 and the pawl lever 300 depending on a rotation radius of the switching lever 600 and the pawl lever 300 when the switching lever 600 and the pawl lever 300 are rotated and may sense the rotation of the switching lever 600 and the pawl lever 300 by direct contacts.

By doing so, the switch part 500 is configured in plural as the first switch part 520 and the second switch part 540 and the first switch part 520 senses the rotation operation of the switching lever 600 rotated while interlocking with the latch lever 200 and the second switch part 540 senses the rotation operation of the pawl lever 300 rotated while interlocking with the latch lever 200. Here, when both of the first switch part 520 and the second switch part 540 are turned on, the driving motor 140 is configured to be operated and when either the first switch part 520 or the second switch part 540 is not turned on, the driving motor 140 is configured not to be operated.

Therefore, the first switch part 520 is configured to be turned on by contacting the switching lever 600 when the switching lever 600 is rotated as the latch lever 200 is rotated by inserting the striker T into the insertion groove 120 and the second switch part 540 may be configured to be turned on by making the contact within the rotation section from a point where the pawl lever 300 is rotated to a point before the pawl lever 300 is locked to the latch lever 200 as the striker T is inserted into the insertion groove 300.

Figure 6:
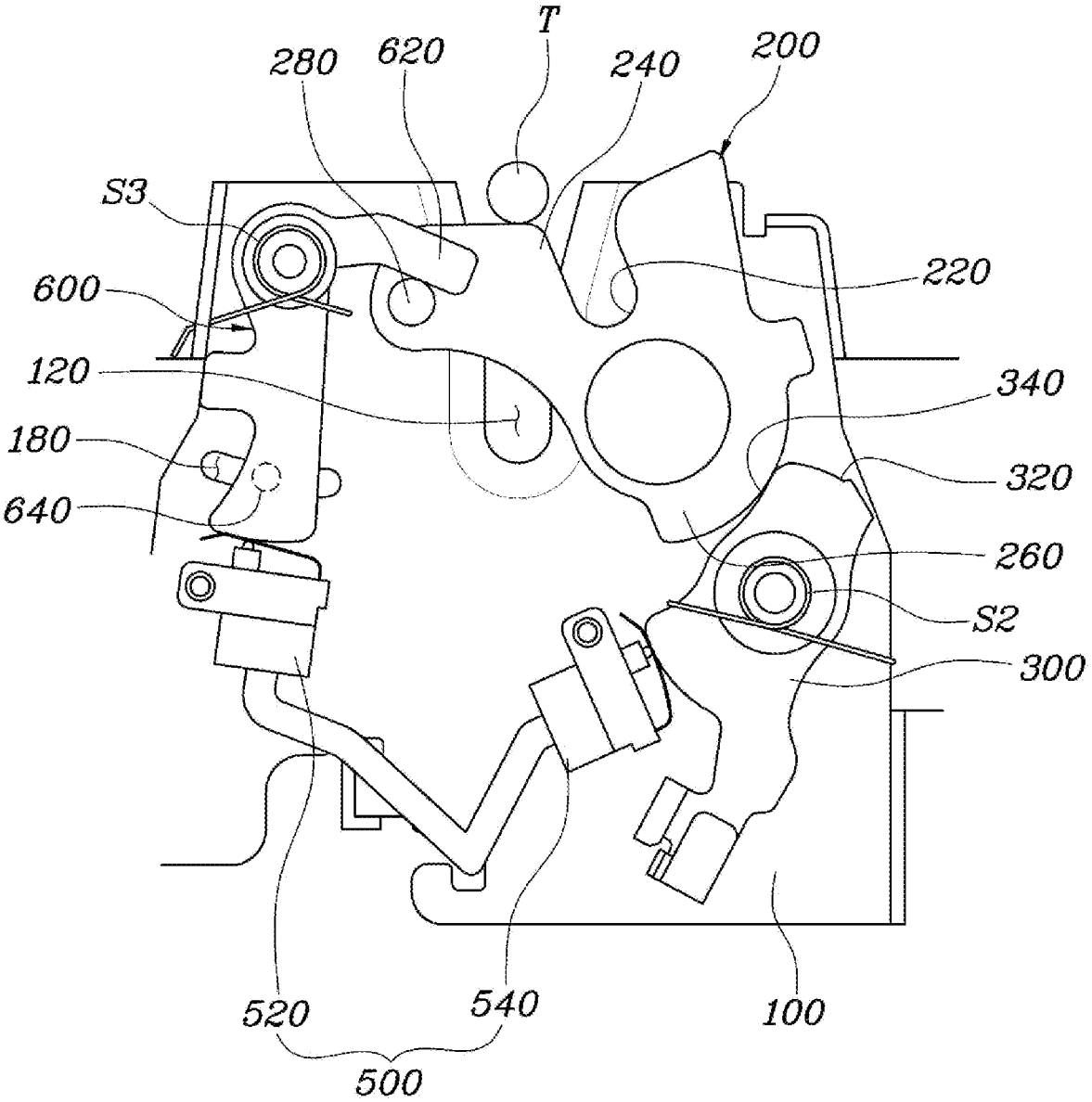

Therefore, as illustrated in FIG. 5, when the striker T is not inserted into the insertion groove 120, as the latch lever 200 is not rotated, the switching lever 600 and the pawl lever 300 are also not rotated, and thus the first switch part 520 and the second switch part 540 are turned off. Here, when the striker T is inserted into the insertion groove 120 by the self weight of the hood, as illustrated in FIG. 6, as the latch lever 200 is rotated, the switching lever 600 and the pawl lever 300 are rotated together, and thus as a portion of the end portion of the switching lever 600 contacts the first switch part 520 and a portion of the end portion of the pawl lever 300 contacts the second switch part 540, the first and second switch parts 520 and 540 are configured to be turned on and thus the driving motor 140 is operated. Therefore, as the cinching lever 440 is rotated and thus the popup lever 420 is forcibly rotated, the latch lever 200 is rotated to enclose the striker T. By doing so, when the latch lever 200 is completely rotated to enclose the striker T, the pawl lever 300 is completely rotated to the area in which the second switch is not sensed, due to the latch lever 200. Therefore, the second switch part 540 is turned off to stop the operation of the driving motor 140 and the cinching lever 440 may return to the original position by the restoring member 442. The operation of the driving motor 140 depending on the turn on/off of the switch part 500 will be again described.

Meanwhile, as illustrated in FIG. 5, the latch lever 200 is protrudedly provided with a fixed protrusion 280 and the switching lever 600 may be mounted to be elastically rotated in the direction in which the striker T is inserted into the insertion groove 120 and may be provided with a locking part 620 extended toward the latch lever 200 to be locked to the fixed protrusion 280. The switching lever 600 may be mounted to be elastically rotated by a torsion spring S3 connected to the base 100 and the rotation of the switching lever 600 may be limited by contacting the locking part 620 with the fixed protrusion 280 of the latch lever 200 and may be rotated by following up the latch lever 200 when the latch lever 200 is rotated.

However, the base 100 is provided with a guide groove 180 extended along the rotation radius of the switching lever 600 and the switching lever 600 is provided with a guide protrusion 640 moving by being guided along the guide groove 180 while being inserted into the guide groove 180, such that the switching lever 600 may move by the formation length of the guide groove 180. Therefore, the guide protrusion 640 is locked to the guide groove 180 to prevent the switching lever 600 from being excessively rotated.

Meanwhile, as illustrated in FIG. 1, the apparatus for a hood latch of the vehicle may further include a release lever 800 configured to be rotatably mounted at the base 100 and connected to be rotated together with the pawl lever 300 and the hook lever 700 when the release lever 800 is rotated. When the release lever 800 is rotated by an operation reflecting the user's intention, the pawl lever 300 and the hook lever 700 are rotated by interlocking with each other, and thus the hook lever 700 is separated from the insertion groove 120 while allowing the rotation of the latch lever 200 that is constrained by the pawl lever 300, such that the striker T may be smoothly separated from the insertion groove 120.

The operation of the present invention will be described below.

As illustrated in FIG. 2, when the striker T moves to the insertion groove 120 beyond the hook lever 700, the one-stage locking is performed to lock the striker T to the hook lever 70 to prevent the striker T from being separated. In this state, when the latch lever 200 and the popup lever 420 are rotated by the striker T by the self weight of the hood, as illustrated in FIG. 5 and FIG. 6, the first switch part 520 is configured to be turned on by contacting the switching lever 600 rotated by interworking with the latch lever 200 and the second switch part 540 is configured to be turned on by contacting the pawl lever 300 rotated by interworking with the latch lever 200, thereby operating the driving motor 140.

By doing so, as the driving motor 140 is operated, the pulling force is applied to the cinching lever 440, and thus as illustrated in FIGS. 3 and 7, the cinching lever 440 is rotated while pulling the popup lever 420. Therefore, as illustrated in FIG. 8, the latch lever 200 is completely rotated by the striker T due to the self weight of the hood to enclose the striker T and the pawl lever 300 is rotated together with the rotation of the latch lever 200 to lock the locking protrusion 260 of the latch lever 200 to the projection 320 of the pawl lever 300. In the instant case, as illustrated in FIG. 8, when the pawl lever 300 is rotated to constrain the rotation of the latch lever 200, as the pawl lever 300 is out of the detecting region of the second switch part 540, the second switch part 540 is turned off to stop the operation of the driving motor 140.

Figure 9:
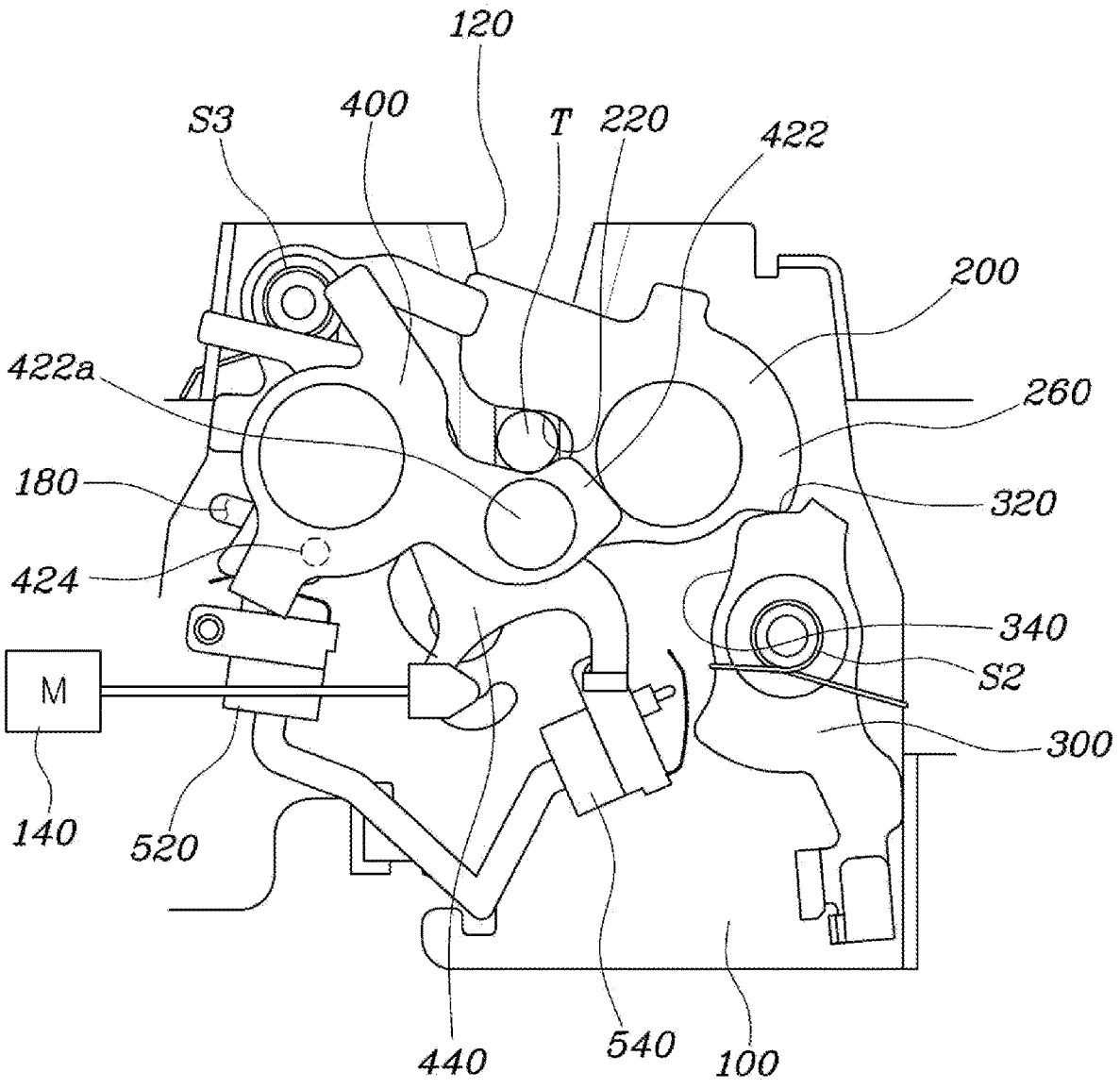

Accordingly, when the operation of driving motor 140 stops, as illustrated in FIGS. 4 and 9, the cinching lever 440 returns to the original position by the elastic force of the restoring member 442, and thus a position of the cinching lever 440 is constrained by the pawl lever 300 in the state in which the latch lever 200 encloses the striker T and the striker T constrained by the latch lever 200 presses the elastic force of the elastic member 160 to maintain the popup lever 420 in the pressed state.

Meanwhile, when the user operates the release lever 800 when the hood is open, the pawl lever 300 and the hook lever 700 are rotated by interlocking with each other, and thus the hook lever 700 is separated from the insertion groove 120 while allowing the rotation of the latch lever 200 that is constrained by the pawl lever 300, such that the striker T may be separated from the insertion groove 120. By doing so, when the latch lever 200 is rotated to allow the separation of the striker, the popup lever 420 is rotated by the elastic member 160 connected to the pin protrusion 422*a* and the popup lever 420 pushes the striker T by the elastic force of the elastic member 160 to open the hood.

According to the apparatus for a hood latch of the vehicle having the above-mentioned structure, the hood that is in the incomplete closed state may be completely closed. The hood is completely closed by the operation of the cinching mechanism when the incomplete closing of the hood is detected to accurately perform the closing of the hood, preventing the safety accident.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "interior", "exterior", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A hood latch apparatus of a vehicle, the hood latch apparatus comprising:

a base configured to be provided with a driving motor and an insertion groove into which a striker is inserted;

a latch lever configured to be adjacently positioned to the insertion groove of the base, rotatably mounted to the base for rotation by the striker when the striker is inserted into the insertion groove, and formed to enclose the striker;

a pawl lever configured to be rotatably mounted to the base so as to interlock with the latch lever so as to be locked to the latch lever when the latch lever is rotated to enclose the striker, thereby fixing the latch lever to prevent the latch lever from rotating;

a cinching mechanism configured to be adjacently positioned to the insertion groove while being spaced apart from the latch lever and rotatably mounted to the base together with the latch lever such that at least one portion of the cinching mechanism is rotatable when the striker is inserted into the insertion groove and is additionally rotated by being supplied with power of the driving motor;

a switch portion configured to be turned on or off depending on a rotation state of the latch lever so as to drive the driving motor to provide the power to the at least one portion of the cinching mechanism when at least one portion of the switch portion is configured to be turned on by a rotation state of the latch lever; and a hook lever configured to be rotatably mounted at the base, configured to have a hook-shaped hook part extended to correspond to the insertion groove, configured to be rotated to a position to allow the insertion of the striker into the insertion groove, and configured to be rotated to a position in which movement of the striker in a direction in which the striker is separated from the insertion groove is limited, wherein the cinching mechanism includes:

a popup lever configured to be adjacently positioned to the insertion groove while being spaced apart from the latch lever and rotatably mounted to the base so as to cooperate with and be rotatable by the striker when the striker is inserted into the insertion groove; and a cinching lever configured to be rotatably mounted to the base so as to be adjacent to the popup lever, the cinching lever configured to be rotated by being supplied with the power of the driving motor, and causing further rotation of the popup lever when the cinching lever is rotated by the power of the driving motor.

2. The hood latch apparatus of claim 1, wherein the latch lever is provided with a latch groove to have the striker inserted thereinto, an extending portion extended to correspond to the insertion groove to contact the striker, and a locking protrusion radially protruding along a circumference thereof, and wherein the latch lever is mounted to elastically return to an original position after a rotation of the latch lever.

3. The hood latch apparatus of claim 2, wherein the pawl lever is provided with a projection locked to the locking protrusion of the latch lever in a state in which rotation of the latch lever is prevented and is mounted to elastically return to an original position thereof after a rotation of the latch lever.

4. The hood latch apparatus of claim 3, wherein the pawl lever is provided with a contact end that is extended to be bent and thus the locking protrusion contacts the contact end when rotation of the latch lever is prevented, and a tip portion of the contact end is provided with the projection.

5. The hood latch apparatus of claim 1, wherein the popup lever is provided with a contact part that is extended to correspond to the insertion groove so as to contact the striker when the striker is inserted into the insertion groove.

6. The hood latch apparatus of claim 5, wherein the contact part of the popup lever is provided with a pin protrusion protruding therefrom and the pin protrusion is connected to an elastic member mounted at the base to apply an elastic force so that the popup lever is rotated in a direction in which the striker is separated from the insertion groove.

7. The hood latch apparatus of claim 1, wherein the cinching lever is applied with the power of the driving motor by a pulling force from the driving motor so as to be rotated and is connected to a restoring member mounted at the base in a direction opposite to a direction in which the pulling force is applied.

8. The hood latch apparatus of claim 1, wherein the cinching lever is provided with a guide protrusion protruding therefrom, and the popup lever is provided with a corresponding protrusion contacting the guide protrusion when the cinching lever is rotated by the power of the driving motor.

9. The hood latch apparatus of claim 1, further including:

a switching lever rotatably mounted to the base so as to interlock with the latch lever when the latch lever is rotated by the insertion of the striker into the insertion groove, wherein the at least one portion of the switch portion includes a first switch portion turned on or off depending on a rotation of the switching lever and a second switch portion turned on or off depending on a rotation of the pawl lever when rotated by the latch lever.

10. The hood latch apparatus of claim 9, wherein the latch lever is provided with a fixed protrusion protruding therefrom, and the switching lever is mounted to be elastically rotated in a direction in which the striker is separated from the insertion groove and is provided with a locking portion extended toward the latch lever so as to be engaged with the fixed protrusion.

11. The hood latch apparatus of claim 9, wherein the base is provided with a guide groove extended along a rotation radius of the switching lever, and the switching lever is provided with a guide protrusion movable along the guide groove so as to guide rotation of the switching lever.

12. The hood latch apparatus of claim 9, wherein the first switch portion is configured to be turned on by contact of the switching lever therewith when the switching lever is rotated as the latch lever is rotated by the insertion of the striker into the insertion groove, and the second switch portion is configured to be turned on by contact with the pawl lever at a point of rotation of the pawl lever when the pawl lever is rotated by the latch lever as the striker is inserted into the insertion groove, the point occurring before the pawl lever has rotated to a position in which the pawl lever prevents the latch lever from rotating.

13. The hood latch apparatus of claim 9, wherein when both of the first switch portion and the second switch portion are turned on, the driving motor is configured to be driven, and when, either the first switch portion or the second switch portion is not turned on, the driving motor is configured not to be driven.

14. The hood latch apparatus of claim 13, wherein when the striker is not inserted into the insertion groove, thereby the latch lever has not been rotated, the switching lever and the pawl lever are not rotated, so as to cause the first switch portion and the second switch portion to be turned off, and, thus the driving motor is configured not to be driven.

15. The hood latch apparatus of claim 13, wherein when the striker is inserted into the insertion groove, the switching lever and the pawl lever are rotated together as the latch lever is rotated, and thus the first switch portion is configured to be turned on by the switching lever and the second switch portion is configured to be turned on by the pawl lever to drive the driving motor to additionally rotate the at least one portion of the cinching mechanism to allow the latch lever to enclose the striker.

16. The hood latch apparatus of claim 1, further including:

a release lever configured to be rotatably mounted at the base and connected as to cause rotation of the pawl lever and the hook lever when the release lever is rotated.

* * * * *